US006153867A

United States Patent [19]

Lee

[11] Patent Number: 6,153,867

[45] Date of Patent: Nov. 28, 2000

[54] HEATER COVER FOR MICROWAVE OVENS USING LIGHT WAVE HEATERS

[75] Inventor: Kwan-Ho Lee, Changwon Gyeongnam, Rep. of Korea

[73] Assignee: LG Electronics Inc., Seoul, Rep. of Korea

[21] Appl. No.: 09/385,437

[22] Filed: Aug. 30, 1999

[30] Foreign Application Priority Data

Nov. 23, 1998 [KR] Rep. of Korea ..... 98-50175

[51] Int. Cl.[7] ..... H05B 6/76

[52] U.S. Cl. ..... 219/685; 219/738; 219/756

[58] Field of Search ..... 219/685, 736, 219/738, 740, 756

[56] References Cited

U.S. PATENT DOCUMENTS

| | | | |
|---|---|---|---|
| 4,051,341 | 9/1977 | Tanaka et al. | 219/740 |
| 5,313,036 | 5/1994 | Chartrain et al. | 219/685 |
| 5,406,057 | 4/1995 | Komatsu et al. | 219/740 |

FOREIGN PATENT DOCUMENTS

| | | |
|---|---|---|
| 51-60042 | 11/1974 | Japan . |
| 97-60245 | 11/1997 | Rep. of Korea . |
| 98-14106 | 7/1998 | Rep. of Korea . |

*Primary Examiner*—Philip H. Leung
*Attorney, Agent, or Firm*—Fleshner & Kim, LLP

[57] ABSTRACT

A heater cover for microwave ovens using halogen heaters in addition to magnetrons is disclosed. The above heater cover is designed to have an optimal opening ratio while effectively protecting the halogen heaters from microwaves and having a desired structural strength. On the heater cover, a plurality of perforations are formed along a plurality of rows with both the same interval between the perforations and a radius "r" of each perforation being three times or more of the interval. The interval between horizontal phantom lines, passing through the centers of the perforations arranged on the rows, is shorter than the diameter "2r" of each perforation. The relation between the radius "r" of each perforation and the wavelength "λ" of microwaves is expressed by the expression, $\lambda/64 \leqq 2r \leqq \lambda/8$. The interval between the perforations ranges from 0.5 mm to 2 mm.

6 Claims, 2 Drawing Sheets

HEATER COVER FOR MICROWAVE OVENS USING LIGHT WAVE HEATERS

BACKGROUND OF THE INVENTION

1. Field of the Invention

The present invention relates, in general, to microwave ovens using light wave heaters, such as halogen heaters capable of radiating high power light waves, in addition to magnetrons and, more particularly, to a heater cover used for shielding and protecting such a halogen heater from a cooking chamber in a microwave oven.

2. Description of the Prior Art

As well known to those skilled in the art, several types of cooking heaters, directly or indirectly using electric energy while cooking, have been proposed and used. An example of the conventional heaters is a microwave oven designed to use microwaves as heating energy while cooking. In such a microwave oven, a magnetron is electrically operated to generate microwaves and applies the microwaves to food in a cooking chamber, thus allowing the microwaves to cause molecular activity in the food. Such molecular activity in the food generates molecular kinetic energy, thus heating and cooking the food. Such microwave ovens are advantageous in that they have a simple construction and are convenient to a user while cooking, and easily and simply heat food in the cooking chamber. The microwave ovens are thus somewhat preferably used for some cooking applications, such as a thawing operation for frozen food or a heating operation for milk requiring to be heated to a desired temperature.

On the other hand, an electronic range, designed to use light waves in place of microwaves as heating energy while cooking, has been proposed as disclosed in U.S. Pat. No. 5,036,179. The above U.S. electronic range is designed to perform various desired cooking modes using a lamp capable of radiating visible rays and infrared rays. That is, this type of electronic range uses a lamp, wherein at least 90% of the radiation energy has a wavelength of not longer than 1 $\mu$m. as a heat source. In said electronic range, both visible rays and infrared rays from the lamp are appropriately used, and it is possible to preferably heat a large quantity of food in a desired cooking mode.

The inventor of this invention proposed a microwave oven, designed to use such light waves in addition to microwaves as heating energy while cooking, in Korean Patent Application Nos. 97-60245 and 98-14106.

FIG. 1 shows the construction of a conventional microwave oven, using light waves in addition to microwaves as heating energy while cooking as proposed by the inventor of this invention. As shown in the drawing, the microwave oven has a cooking chamber 2 within an oven cavity 1, with two halogen heaters 10 installed on the top wall of the cavity 1. A heater box 14 covers the halogen heaters 10 at a position above the heaters 10, thus shielding and protecting the heaters 10 from surroundings. A heater cover 12 is installed at a position between the heaters 10 and the cooking chamber 2. In the drawing, the reference numeral 3 denotes a machine room for both a magnetron and a high voltage transformer.

The heater cover 12 is densely holed to have a plurality of perforations 12*a* through which both the visible rays and the infrared rays pass, radiated from the halogen heaters 10, to be introduced into the cooking chamber 2. The heater cover 12 has a collateral function of almost complete prevention of undesirable transmission of microwaves from the cooking chamber 2 to the halogen heaters 10.

In order to allow a smooth radiation of the light waves from the heaters 10 into the cooking chamber 2 while accomplishing such an almost complete prevention of undesirable transmission of microwaves from the chamber 2 to the halogen heaters 10, it is necessary to optimally design the profile, the size and the intervals of the perforations 12*a*. Of course, it may be preferable to make large-sized perforations 12*a* or to directly expose the heaters 10 to the upper portion of the chamber 2 so as to accomplish the smooth radiation of the light waves from the heaters 10 into the chamber 2. However, when the halogen heaters 10 are designed to be exceedingly exposed to the chamber 2 as described above, the heaters 10 may be easily affected by the microwaves from the chamber 2, thus being undesirably damaged or undesirably shortened in its expected life span. When the perforations 12*a* are designed to have an exceedingly small size, they reduce the amount of light waves effectively radiated from the heaters 10 into the chamber 2. In addition, such small-sized perforations 12*a*may cause the heater cover 12 and/or the heater box 14 to be easily damaged by heat.

FIG. 2 shows the construction of a conventional heater cover 12. As shown in the drawing, the conventional heater cover 12 has a plurality of perforations 12*a*. In the cover 12, the perforations 12*a* are arranged in a matrix with both a regular interval G between the rows L1, L2 and L3 of the perforations 12*a* and intervals a and b between the perforations 12*a*. In the conventional cover 12, the intervals G, a and b in addition to the size of the perforations 12*a* are not precisely set, but are roughly determined.

An example of conventional heater covers having such perforations may be referred to Japanese Patent Laid-open Publication No. Sho. 51-60,042. In the above Japanese heater cover, the size of perforations is set to 0.8 mm or less, while the interval between the perforation centers is set to 1.2 mm or less. The above dimensions finally set the interval between the edges of the perforations to 0.4 mm. However, it is almost impossible to form such perforations on a heater cover through a conventional physical process, such as a punching process. Therefore, a chemical process, such as an etching process, is used for forming such perforations. Such a chemical process of forming the perforations undesirably increases the production cost of heater covers in comparison with physical processes. In addition, the structure of the above Japanese heater cover is problematic as follows.

That is, the above heater cover 12 fails to have an optimal structure, which allows a smooth radiation of light waves from the halogen heaters 10 into the cooking chamber 2 while accomplishing the almost complete prevention of the undesirable transmission of microwaves from the chamber 2 to the halogen heaters 10. In other words, it is almost impossible to accomplish an optimal opening ratio of the heater cover 12 with the perforations 12*a* designed as shown in FIG. 2. Such perforations 12*a* reduce transmissivity of light waves through the heater cover 12, thus finally deteriorating thermal efficiency of the heaters 10. Particularly, in the case of high power halogen heaters, the heater cover 12 may be easily and thermally deformed or damaged.

FIG. 3 shows the construction of another type of conventional heater cover. In this heater cover, the perforations 12*a* are designed to be individually shaped in a rectangular profile. In the above heater cover 12, the length of each side of a rectangular perforation 12*a* is set to A. In addition, the interval between the rows L1, L2 and L3 of the perforations 12*a*, or the interval between the rectangular perforations 12*a*, is set to a'. The diagonal length of each rectangular perforation 12*a*is set to D.

When the arrangement of such rectangular perforations 12*a* is designed to have the shortest interval a' capable of maximizing the opening ratio of the heater cover 12, or when the interval a' remains the same as the interval a of the circular perforations 12*a* of FIG. 2, the heater cover 12 is problematic in that it fails to have a desired structural strength. Therefore, it is necessary for the heater cover 12, having such rectangular perforations 12*a*, to have an interval a' larger than that of the circular perforations. When the arrangement of the rectangular perforations 12*a* is designed as described above, a desired structural strength of the heater cover 12 is accomplished. However, such an arrangement of the rectangular perforations 12*a* reduces the opening ratio of the heater cover 12.

When the length A of each side of a rectangular perforation 12*a* is set to the diameter 2r of a circular perforation, the diagonal length D of the rectangular perforation 12*a* becomes larger than the diameter 2r of the circular perforation. In such a case, the heater cover 12 is seriously affected by the microwaves from the cooking chamber 2 and is undesirably reduced in structural strength. In order to allow the heater cover 12 having the rectangular perforations 12*a* to accomplish the same microwave shielding effect as that expected from the heater cover having the circular perforations, the diagonal length D of each rectangular perforation 12*a* may be set to the diameter 2r of each circular perforation. However, this undesirably reduces the opening ratio of the heater cover 12 and finally reduces thermal efficiency of the halogen heaters 10.

In this regard, it is necessary for manufacturers of such microwave ovens using halogen heaters 10 to design the heater cover 12 with an optimal opening ratio, an effective protection of the halogen lamps 10 from microwaves, and a desired structural strength. This object may be accomplished by optimally designing both the diameter of each perforation 12*a* of the heater cover and the intervals G, a and b of the perforations 12*a*.

SUMMARY OF THE INVENTION

Accordingly, the present invention has been made keeping in mind the above problems occurring in the prior art, and an object of the present invention is to provide a heater cover for microwave ovens using halogen heaters in addition to magnetrons, which is designed to have an optimal opening ratio while effectively protecting the halogen heaters from microwaves.

Another object of the present invention is to provide a heater cover for microwave ovens using halogen heaters in addition to magnetrons, which is designed to have an optimal opening ratio while having a desired structural strength.

In order to accomplish the above object, the present invention provides a heater cover for microwave ovens using halogen heaters, comprising: a plurality of perforations formed on the heater cover to allow light waves from the halogen heaters to pass through, the perforations being arranged along a plurality of rows on the heater cover with both the same interval between the perforations and a radius "r" of each of the perforations being three times or more of the interval.

In the above heater cover, the interval between horizontal phantom lines, passing through the centers of the perforations arranged on the rows, is shorter than the diameter "2r" of each of the perforations.

In addition, the relation between the radius "r" of each of the perforations and the wavelength "λ" of a microwave is expressed by the expression, $\lambda/64 \leqq 2r \leqq \lambda/8$.

The interval between the perforations ranges from 0.5 mm to 2 mm.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

The present invention is to form a plurality of perforations on a heater cover while accomplishing an optimal opening ratio, an effective protection of the halogen heaters from microwaves, and a desired structural strength. In order to accomplish the above object, it is necessary to achieve the following factors while designing the heater cover. That is, the effective protection of the halogen heaters from microwaves may be accomplished by minimizing the opening ratio of the heater cover. On the other hand, it is necessary to increase the opening ratio of the heater cover in order to allow the light waves of the halogen heaters to smoothly pass through the heater cover. The structural strength of the heater cover may be improved by reducing the opening ratio of the heater cover and by lengthening the intervals between the perforations, and by optimally arranging the perforations on the heater cover.

Figure 4:
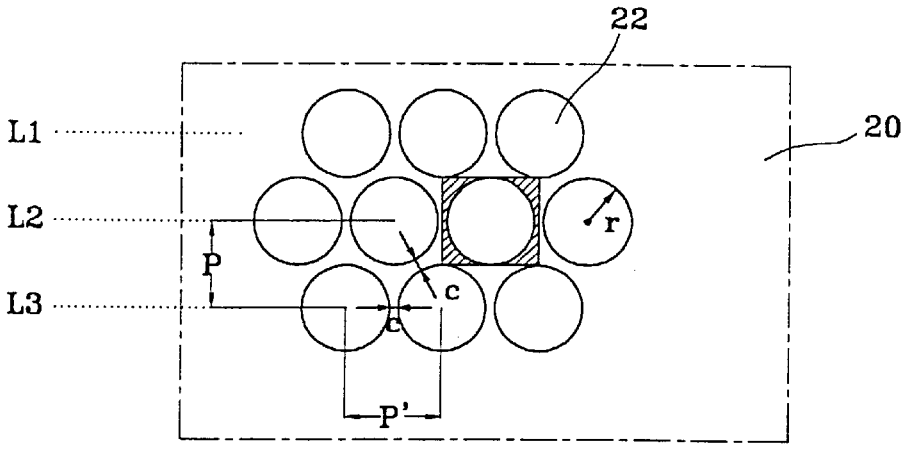
FIG. 4 is a plan view, showing an arrangement of circular perforations on a heater cover in accordance with the preferred embodiment of the present invention.
Figure 5:
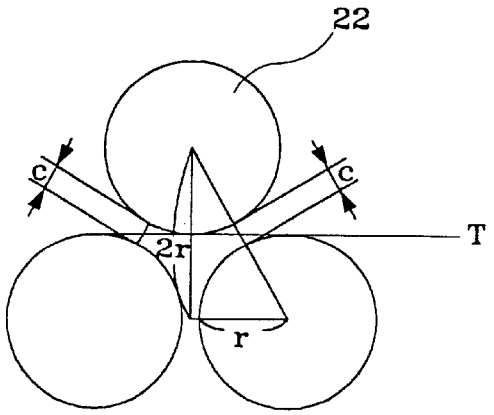
FIG. 5 is a view, illustrating the dimensions of the circular perforations formed on the heater cover of this invention.

The present invention accomplishes the above factors by making equal intervals c between the perforations 22 without leaving any interval between the rows of perforations 22 while forming the perforations 22 along the rows L1, L2 and L3 on the heater cover 20 as shown in FIGS. 4 and 5. In the above description, the sentence "without leaving any interval between the rows of perforations 22" means that the perforations 22 on neighboring rows L1, L2 and L3 are arranged along the rows while commonly having one tangent line T as best seen in FIG. 5.

The unique arrangement of the perforations 22 of this invention will be described in more detail hereinbelow with reference to FIG. 5. In the drawing, the intervals between the perforations 22 is set to "c", while the radius of each perforation 22 is set to "r". When the interval between the rows L1, L2 and L3 of the perforations is zero, or when the perforations 22 on neighboring rows L1, L2 and L3 are arranged along the rows while commonly having one tangent line T as described above with the same interval between the perforations 22, the following expression (1) of relation is established according to Pythagorean theorem.

$$(r+c/2)^2+(2r)^2=(2r+c)^2 \quad (1)$$

When the above expression (1) is rearranged to output the following expression (2) of relation between the radius r of each perforation 22 and the interval c between the perforations 22.

$$R=3.23c \quad (2)$$

The above expression (2) means that the intervals between the perforations 22 become equal to each other when the radius r of each perforation 22 is set to 3.23 times of the interval c. Of course, it should be understood that the above expressions are established, with the interval between the rows L1, L2 and L3 of the perforations being zero, or the perforations 22 on neighboring rows L1, L2 and L3 being arranged along the rows while commonly having one tangent line T.

Therefore, if r>3.23c, the same interval c between the perforations 22 has to make the neighboring rows L1, L2 and L3 of the perforations 22 undesirably overlapped. This means that the interval between horizontal phantom lines, passing through the centers of the perforations 22 arranged on the rows L1, L2 and L3, is shorter than the diameter 2r of each perforation 22. In such a case, the opening ratio of the heater cover 20 may be relatively increased.

On the contrary, if r>3.23c, the same interval c between the perforations 22 has to make the neighboring rows L1, L2 and L3 of the perforations 22 undesirably spaced apart from each other. This means that the interval between the phantom lines, passing through the centers of the perforations 22 arranged on the rows L1, L2 and L3, is longer than the diameter 2r of each perforation 22. In such a case, the opening ratio of the heater cover 20 may be relatively reduced.

Therefore, in order to increase the opening ratio of the heater cover 20, it is necessary to design the radius r of each perforation 22 to be 3 times or more, most precisely, 3.23 times of the interval c of the perforations 22.

In addition, it is preferable to set the diameter 2r of each perforation 22 to ⅛ times or less of the wavelength λ of microwaves of a magnetron in order to effectively prevent the microwaves from being transmitted from the cooking chamber to the halogen heaters through the heater cover 20. On the other hand, it is preferable to set the diameter 2r of each perforation 22 to be larger than λ/64 in order to meet an expression r>3.23c while giving a desired structural strength to the heater cover 20. Therefore, the diameter 2r of each perforation 22 is expressed by the following expression (3).

$$\lambda/64 \leqq 2r \leqq \lambda/8 \quad (3)$$

In such a case, the interval c between the perforations 22 is preferably and typically set to a range from 0.5 mm to 2 mm.

Figure 1:
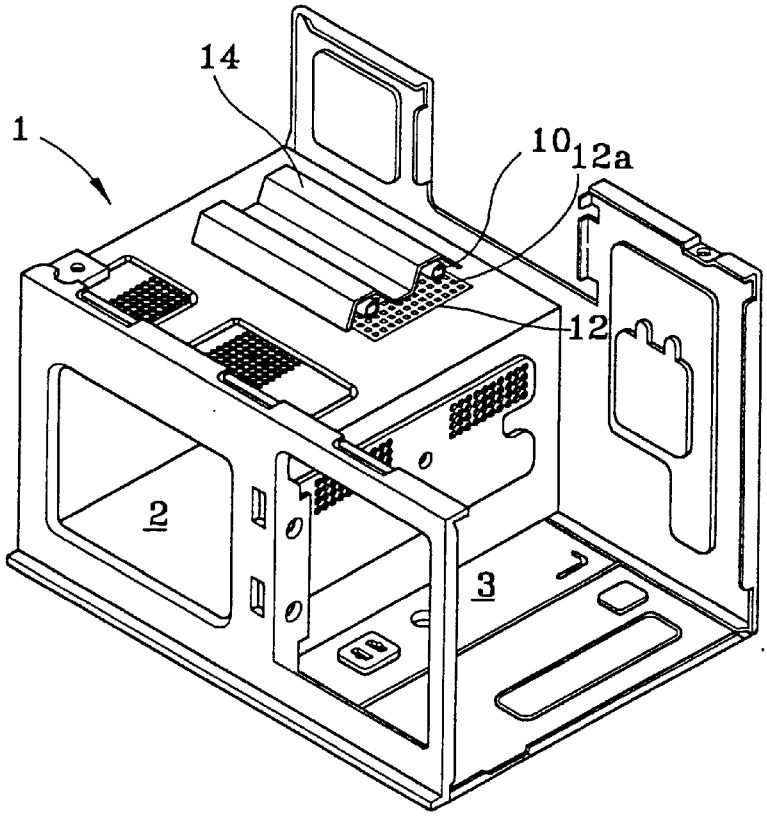
FIG. 1 BACKGROUND ART
FIG. 1 is a perspective view, showing the construction of a conventional microwave oven utilizing halogen heaters as a heat source in addition to a magnetron.
Figure 2:
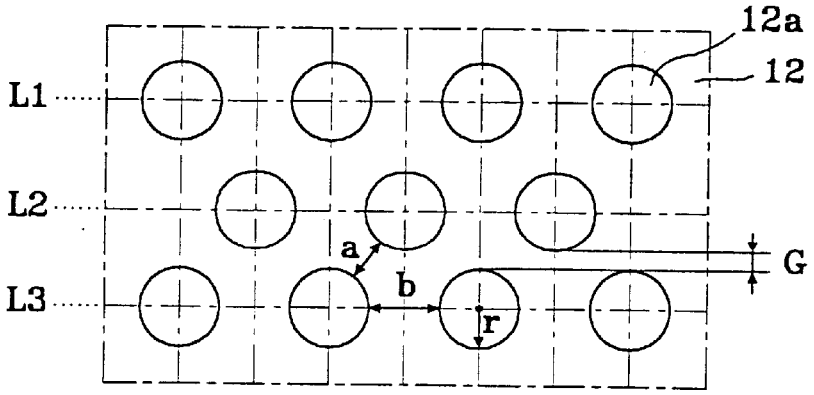
FIG. 2 BACKGROUND ART
FIG. 2 is a plan view, showing an arrangement of circular perforations on a heater cover in accordance with an embodiment of the prior art.
Figure 3:
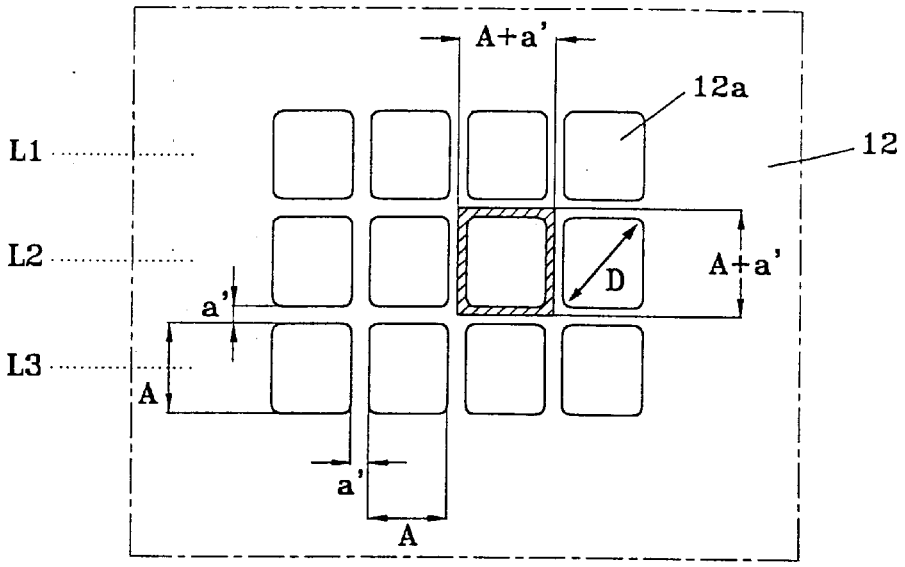
FIG. 3 BACKGROUND ART
FIG. 3 is a plan view, showing an arrangement of rectangular perforations on a heater cover in accordance with another embodiment of the prior art.

On the other hand, the practical opening ratio of a heater cover will be calculated as follows with reference to the conventional heater cover 12 of FIG. 3 and the present heater cover 20 of FIG. 4.

In the case of the conventional heater cover 12 of FIG. 3, the practical opening ratio is calculated as follows. That is, when setting the length of a side of each perforation 12*a* to 6 mm, the interval a' between the perforations 12*a* to 1 mm, and the curvature R of the rounded corner of each perforation 12 to 2 mm, the opening ratio of the heater cover 12 is the ratio of the area of each perforation 12*a* to the total area of the area of each perforation 12*a* and the area of the deviant-creased part of FIG. 3. That is, the opening ratio of the heater cover 12 is $\{6.0\times6.0-(2\times2-\pi\times2\times2/4\}/7.0\times7.0$, or 71.7%.

In the case of the present heater cover 20 of FIG. 4, the practical opening ratio is calculated as follows. That is, when setting the diameter 2r of each perforation 22 to 7 mm, the interval c between the perforations 22 to 1 mm, and the length P of a phantom line extending between the centers of the perforations 22 on the neighboring rows L1, L2 and L3 to 6.8 mm, and the length P' of a phantom line extending between the centers of the neighboring perforations 22 on each row L1, L2 or L3 to 7.8 mm, the opening ratio of the heater cover 20 is $(\pi\times7.0\times7.0/4)/7.8\times6.8$, or 72.5% when it is calculated in the same manner as that described for the conventional heater cover 12 of FIG. 3.

Therefore, it is noted that the heater cover 20 of this invention accomplishes a somewhat increased opening ratio, an effective protection of the halogen heaters from microwaves, and a desired structural strength in comparison with the conventional heater cover.

As described above, the present invention provides a heater cover for microwave ovens using light wave heaters, such as halogen heaters capable of radiating high power light waves, in addition to magnetrons. In the heater cover of this invention, the radius r of each perforation is designed to be 3 times or more of the interval of the perforations. In addition, it is also necessary to design the arrangement of the perforations on the heater cover to leave no interval between the neighboring rows of perforations. The size of each perforation is optimally designed to be limited within a predetermined range, thus effectively reducing the amount of microwaves transmitted from the cooking chamber to the halogen heaters through the heater cover. When the perforations on the heater cover are designed while accomplishing the above contradictive factors, the heater cover accomplishes a somewhat increased opening ratio, an effective protection of the halogen heaters from microwaves, and a desired structural strength. That is, the heater cover of this invention effectively protects the halogen heaters from microwaves and effectively transmits light waves from the halogen heaters into the cooking chamber while having a desired structural strength. The heater cover thus improves the operational reliability and market competitiveness of the microwave ovens. The heater cover also improves the thermal efficiency of the halogen heaters, thus saving time while cooking.

Although the preferred embodiments of the present invention have been disclosed for illustrative purposes, those skilled in the art will appreciate that various modifications, additions and substitutions are possible, without departing from the scope and spirit of the invention as disclosed in the accompanying drawings.

What is claimed is:

1. A heater cover for a microwave oven using halogen heaters, comprising:

a cover member configured to be interposed between halogen heaters and a cooking cavity of a microwave oven, wherein a plurality of perforations are formed on the cover member to allow light waves from said halogen heaters to pass through the cover member and into the cooking cavity, said perforations being arranged along a plurality of rows on the cover member with both the same interval between the perforations and a radius "r" of each of the perforations being three times or more of said interval.

2. The heater cover according to claim 1, wherein the perforations are arranged on the cover member such that a distance between two lines, passing through centers of adjacent rows of the perforations is shorter than a diameter "2r " of each of the perforations.

3. The heater cover according to claim 1, wherein the heater cover is configured such that when the heater cover is used in a microwave oven that produces microwaves having a wavelength λ, said radius "r" of each of the perforations satisfies the expression, $\lambda/64 \leqq 2r \leqq \lambda/8$.

4. The heater cover according to claim 1, wherein the interval between the perforations ranges from 0.5 mm to 2 mm.

5. A heater cover for a microwave oven, comprising:

a cover member configured to be positioned between heat lamps of a microwave oven and a cooking cavity of the microwave oven, wherein the cover member has a plurality of circular perforations passing therethrough, wherein the perforations are arranged in rows, wherein a distance "c" between edges of all adjacent perforations is substantially the same, and wherein a radius "r" of the perforations satisfies the formula $r>3.23c$.

6. The heater cover of claim 5, wherein the perforations are arranged such that a distance "d" between two lines passing through centers of adjacent rows of the perforations satisfies the formula $d<2r$.

* * * * *